US006820580B2

(12) United States Patent
Naito et al.

(10) Patent No.: US 6,820,580 B2
(45) Date of Patent: Nov. 23, 2004

(54) VALVE DRIVING DEVICE FOR ENGINE

(75) Inventors: Masahiro Naito, Hiroshima (JP); Masaki Fukuma, Hiroshima (JP); Kouichi Shimizu, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 10/772,289

(22) Filed: Feb. 6, 2004

(65) Prior Publication Data

US 2004/0154566 A1 Aug. 12, 2004

(30) Foreign Application Priority Data

Feb. 12, 2003 (JP) ..... 2003-033213

(51) Int. Cl.[7] ..... F01L 1/34
(52) U.S. Cl. ..... 123/90.17; 123/90.15
(58) Field of Search ..... 123/90.15, 90.17, 123/90.13

(56) References Cited

U.S. PATENT DOCUMENTS 5,626,108 A * 5/1997 Kato et al. ..... 123/90.15

FOREIGN PATENT DOCUMENTS

JP 11-280414 10/1999

* cited by examiner

*Primary Examiner*—Thomas Denion
*Assistant Examiner*—Zelalem Eshete
(74) *Attorney, Agent, or Firm*—Nixon Peabody LLP; Donald R. Studebaker

(57) ABSTRACT

A rotational angle sensor and a hydraulic pressure control valve are disposed such that a detecting end surface of the rotational angle sensor disposed close to a sensor rotor attached to an exhaust camshaft is located in a spray area of return oil discharged through a drain hole formed at a cam cap, which flows down through a lower drain port of the hydraulic pressure control valve attached on the cam cap from a variable valve timing mechanism. Further, the detecting end surface is located forward in the rotational direction, shown as the arrow a, of the exhaust camshaft so that the return oil can be positively carried toward the detecting end surface by the rotation of the sensor rotor. Accordingly, this can maintain properly detecting accuracy of the rotational sensor disposed close to the camshaft.

10 Claims, 5 Drawing Sheets

VALVE DRIVING DEVICE FOR ENGINE

BACKGROUND OF THE INVENTION

The present invention relates to a valve driving device for an engine, and more specifically to a valve driving device equipped with a variable valve timing mechanism capable of changing a rotational phase of a camshaft with respect to a crankshaft of an engine.

Recently, engines for vehicles have been equipped with a valve driving device for changing valve timing (open and/or close timing) of an intake valve and/or an exhaust valve to increase engine power, improve gas mileage and so on. In general, the valve driving device includes a hydraulic (oil) pressure operating type of variable valve timing mechanism operative to change valve timing by changing a rotational phase of a camshaft with respect to a crankshaft of the engine. An example of such mechanism is disclosed in Japanese Patent Laid-Open Publication No. 11-280414.

In a variable valve timing mechanism disclosed in the above-described publication, a rotor is fixed to one end of an intake camshaft and a housing (casing) is fixed to a sprocket (pulley) which is attached so as to be relatively rotatable with respect to the intake camshaft. Further, the rotor and the housing jointly form a hydraulic (oil) pressure chamber for advance timing (a pressure receiving chamber at advance timing side) and a hydraulic (oil) pressure chamber for delay timing (a pressure receiving chamber at delay timing side). When a hydraulic (oil) pressure control valve for controlling a supply of operating hydraulic (oil) pressure allows the operating hydraulic pressure to act on the hydraulic pressure chamber for advance timing, the rotor is rotated slightly with respect to the housing in a rotational direction of the intake camshaft. As a result, the valve timing of the intake valve advances. On the other hand, when the hydraulic pressure control valve allows the operating hydraulic pressure to act on the hydraulic pressure chamber for delay timing, the rotor is rotated with respect to the housing in an opposite direction to the rotation of the intake camshaft. As a result, the valve timing of the intake valve delays.

Further, a sensor rotor (sensing plate) is attached to the intake camshaft and a rotational angle sensor (cam-angle sensor) is disposed close to the sensor rotor. The rotational angle sensor detects a rotational phase of the intake camshaft, i.e., valve timing of the intake valve.

Such rotational angle sensor includes a detecting end surface. In general, since the detecting end surface of the sensor is located inside of a cylinder head cover of the engine, mists of lubricant oil splashed in the cylinder head adhere on the detecting surface of the sensor. Meanwhile, particulates, such as metal particulates generated by metal parts contacting each other and sworn off, get mixed in the lubricant oil. Most particulates are trapped by an oil filter and the like and then took out of the lubricant oil. However, some particulates remain in the lubricant oil without being trapped, and those particulates may accumulate on the detecting end surface of the sensor. This may cause a problem that the detecting end surface of the rotational angle sensor is covered inappropriately with such particulates, result in deterioration of detecting accuracy of the sensor.

SUMMARY OF THE INVENTION

The present invention has been devised in view of the above-described problems, and an object of the present invention is to provide a valve driving device for an engine that maintains properly detecting accuracy of a rotational sensor disposed close to a camshaft.

In order to achieve the above-described object, the first aspect of the present invention provides a valve driving device for an engine, comprising a variable valve timing mechanism disposed at an end portion of a camshaft driving an intake valve and/or an exhaust valve synchronously with a crankshaft of the engine, the variable valve timing mechanism being a hydraulic-pressure operating type of variable valve timing mechanism that is capable of changing a rotational phase of the camshaft with respect to the crankshaft, a hydraulic pressure control valve operative to control a supply of an operating hydraulic pressure to the variable valve timing mechanism, a rotational angle sensor operative to detect a rotational angle of the camshaft, the rotational angle sensor being a solenoid-pickup type of sensor and including a detecting end surface that is disposed close to a rotational area of a sensor rotor attached to the camshaft. Herein, the hydraulic pressure control valve includes a drain hole, return oil from the variable valve timing mechanism is discharged through the drain hole of the hydraulic pressure control valve, and the rotational angle sensor and the hydraulic pressure control valve are disposed such that the detecting end surface of the rotational angle sensor is located in a spray area of the return oil discharged through the drain hole.

While the variable valve timing mechanism changes a rotational phase of the camshaft, the return oil is discharged through the drain hole of the hydraulic pressure control valve. According to the valve driving device of the first aspect of the invention, the discharged return oil can be directed toward the detecting end surface of the rotational angle sensor. Accordingly, the detecting end surface can be prevented from being covered inappropriately with the metal particulates or the like, thereby maintaining properly detecting accuracy of the rotational sensor without any other particular measures.

The second aspect of the present invention provides the valve driving device for an engine of the first aspect of the invention, wherein the hydraulic pressure control valve further includes a spool, a holder for retaining the spool and a solenoid for driving the spool, and the drain hole is formed at the holder.

According to the valve driving device of the second aspect of the invention, the first aspect of the invention is further materialized for the hydraulic pressure control valve and the drain hole. Further, for example, it may be possible to have a cam cap, which supports the camshaft from above, function as the holder. In this case, the device may have the advantage of a simple structure with small-number parts and compactness.

The third aspect of the present invention provides the valve driving device for an engine the first aspect of the invention, wherein the rotational angle sensor is attached to a portion of a cylinder head cover that is close to the hydraulic pressure control valve.

According to the valve driving device of the third aspect of the invention, since it is relatively easy to attach some parts to the cylinder head cover, this can improve flexibility of selection or adjustability of attaching place for the rotational angle sensor. Further, the close location of the rotational angle sensor with respect to the hydraulic pressure control valve can assure the washing function of the detecting end surface of the rotational angle sensor by the return oil.

The fourth aspect of the present invention provides the valve driving device for an engine of the second aspect of the invention, wherein the hydraulic pressure control valve is disposed such that an axis of the spool thereof extents substantially in a vertical direction of the engine.

In general, the drain hole of the hydraulic pressure control valve is configured so as to be flat shaped, having its long axis perpendicular to the axis of the spool. Accordingly, a spray of the return oil discharged through the drain hole spreads in a horizontal direction. Thus, according to the valve driving device of the fourth aspect of the invention, it can be relatively easy for the detecting end surface of the rotational angle sensor to be located in the return oil's spray area spread in the horizontal direction with its close position to the sensor rotor, thereby improving flexibility of its location. Since generally it would be preferred from designing stand point to have more flexibility in the horizontal direction than that in the vertical direction for parts of the engine, the above-described disposition of the hydraulic pressure control valve is meaningful.

The fifth aspect of the present invention provides the valve driving device for an engine of the first aspect of the invention, wherein the rotational angle sensor is disposed so as to locate close to and at the front of the drain hole of the hydraulic pressure control valve with respect to a rotational direction of the camshaft.

According to the valve driving device of the fifth aspect of the invention, the return oil discharged through the drain hole of the hydraulic pressure control valve can be positively carried toward the rotational angle sensor by the rotation of the sensor rotor attached to the exhaust camshaft. As a result, the amount of oil carried to the detecting end surface increases. Thus, it can promote washing of the detecting end surface of the rotational angle sensor by the return oil.

The sixth aspect of the present invention provides valve driving device for an engine, comprising a variable valve timing mechanism disposed at an end portion of a camshaft driving an intake valve and/or an exhaust valve synchronously with a crankshaft of the engine, the variable valve timing mechanism being a hydraulic-pressure operating type of variable valve timing mechanism that is capable of changing a rotational phase of the camshaft with respect to the crankshaft, a hydraulic pressure control valve operative to control a supply of an operating hydraulic pressure to the variable valve timing mechanism, the hydraulic pressure control valve including a spool, a holder for retaining the spool and a solenoid for driving the spool, a rotational angle sensor operative to detect a rotational angle of the camshaft, the rotational angle sensor being a solenoid-pickup type of sensor and including a detecting end surface that is disposed close to a rotational area of a sensor rotor attached to the camshaft. Herein, the hydraulic pressure control valve further includes a drain hole that is formed at the holder, return oil from the variable valve timing mechanism is discharged through the drain hole of the hydraulic pressure control valve, and the rotational angle sensor and the hydraulic pressure control valve are disposed close to each other such that a spray of the return oil discharged through the drain hole is directed toward the detecting end surface of the rotational angle sensor.

According to the valve driving device of the sixth aspect of the invention, substantially the same functions and effects as the above-described first aspect of the invention can be obtained.

The seventh aspect of the present invention provides the valve driving device for an engine of the sixth aspect of the invention, wherein the rotational angle sensor is attached to a portion of a cylinder head cover that is close to the hydraulic pressure control valve.

The eighth aspect of the present invention provides the valve driving device for an engine of the sixth aspect of the invention, wherein the hydraulic pressure control valve is disposed such that an axis of the spool thereof extents substantially in a vertical direction of the engine.

The ninth aspect of the present invention provides the valve driving device for an engine of the sixth aspect of the invention, wherein the rotational angle sensor is disposed so as to locate close to and at the front of the drain hole of the hydraulic pressure control valve with respect to a rotational direction of the camshaft.

According to the valve driving device of the seventh though ninth aspects of the invention, substantially the same functions and effects as the above-described third through fifth aspects of the invention can be obtained respectively.

The tenth aspect of the present invention provides the valve driving device for an engine of the sixth aspect of the invention, wherein the holder of the hydraulic pressure control valve is formed of a cam cap that supports the camshaft rotatably together with a cylinder head of the engine.

According to the valve driving device of the tenth aspect of the invention, since the cam cap is used so as to function as the holder for retaining the spool of the hydraulic pressure control valve, this can provide the advantage of a simple structure with small-number parts and compactness.

BRIEF DESCRIPTION OF THE DRAWINGS

Other features, aspects, and advantages of the present invention will become apparent from the following description of the present invention which refers to the accompanying drawings.

DETAILED DESCRIPTION OF THE INVENTION

Hereinafter, a valve driving device for an engine according to a preferred embodiment of the present invention will be described with reference to the accompanying drawings.

Figure 1:
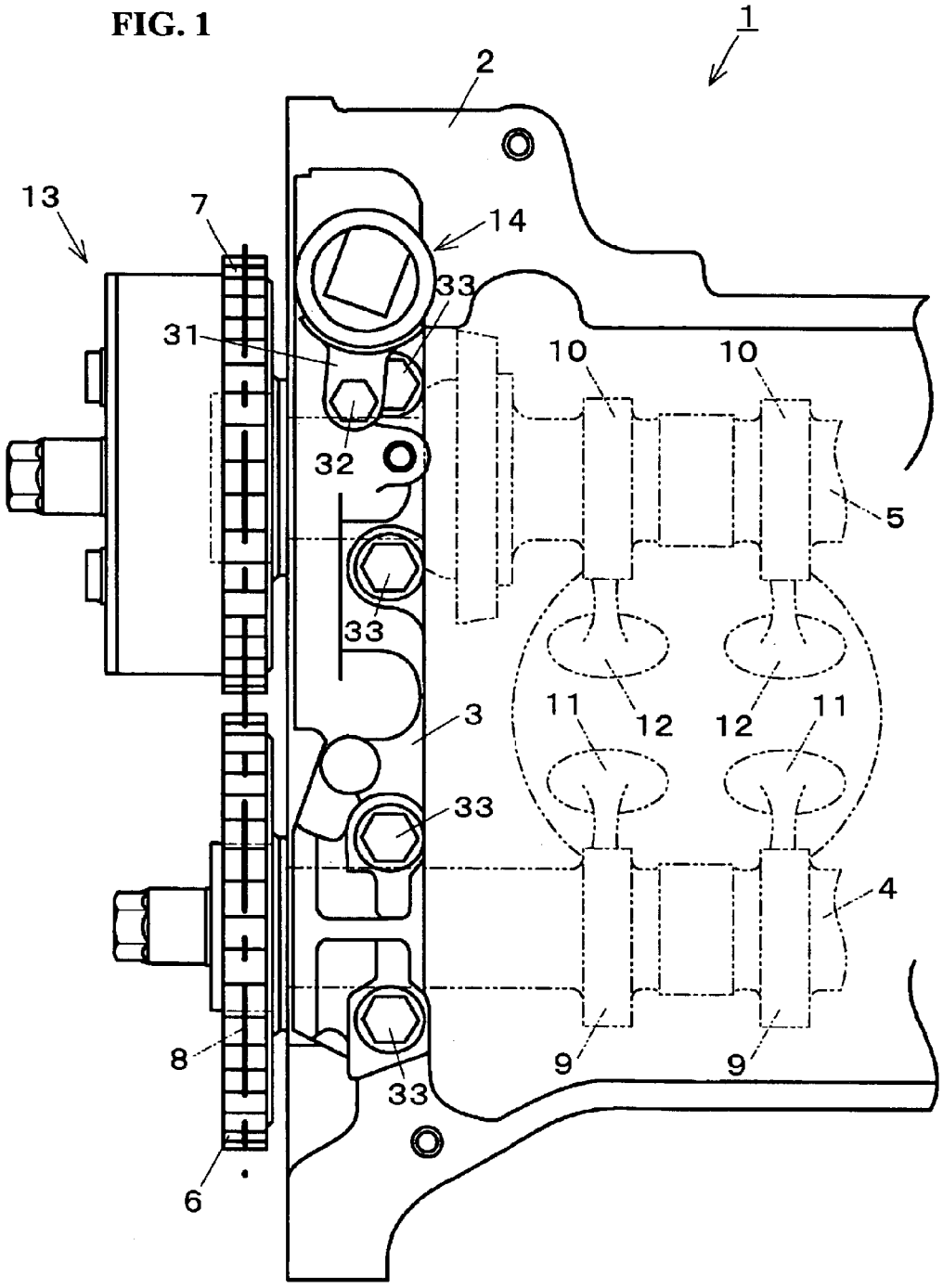
FIG. 1 is a plan view for showing an essential part of a valve driving device for an engine according to a preferred embodiment of the present invention.

As shown in FIG. 1, an engine 1 is provided with an intake camshaft 4 and an exhaust camshaft 5, which are disposed in parallel to a crankshaft of the engine (not shown in any drawing) and rotatably supported by both of a cylinder head 2 located below and a cam cap 3 located above. An endless chain 8 is provided so as to be wound round sprockets 6, 7 attached to the camshafts 4, 5 and a sprocket (not shown in any drawing) attached to the crankshaft of the engine.

Accordingly, both the sprockets 6, 7, and thereby both the camshafts 4, 5 rotate synchronously with the crankshaft, so that a plurality of cams 9 . . . 9, 10 . . . 10 (two of cams shown in the drawing) fixed to each camshafts 4, 5 respectively can drive a plurality of intake and exhaust valves 11 . . . 11, 12 . . . 12 (two of valves shown each in the drawing).

Further, the engine 1 is provided with a valve driving device for changing valve timing (open and/or close timing) of the exhaust valves 12 . . . 12 which includes a variable valve timing mechanism 13. Specifically, the sprocket 7 is assembled to the exhaust camshaft 5 so that it can be relatively movable with respect to the camshaft 5 within a certain range, and there is provided a hydraulic (oil) pressure operating type of variable valve timing mechanism 13 at an sprocket 7 side end of the exhaust camshaft 5. The variable valve timing mechanism 13 is capable of changing a rotational phase of the camshaft 5 with respect to the crankshaft of the engine. Further, a hydraulic (oil) pressure control valve 14 for controlling a supply of an operating hydraulic (oil) pressure to the variable valve timing mechanism 13 is attached on the cam cap 3.

Figure 2:
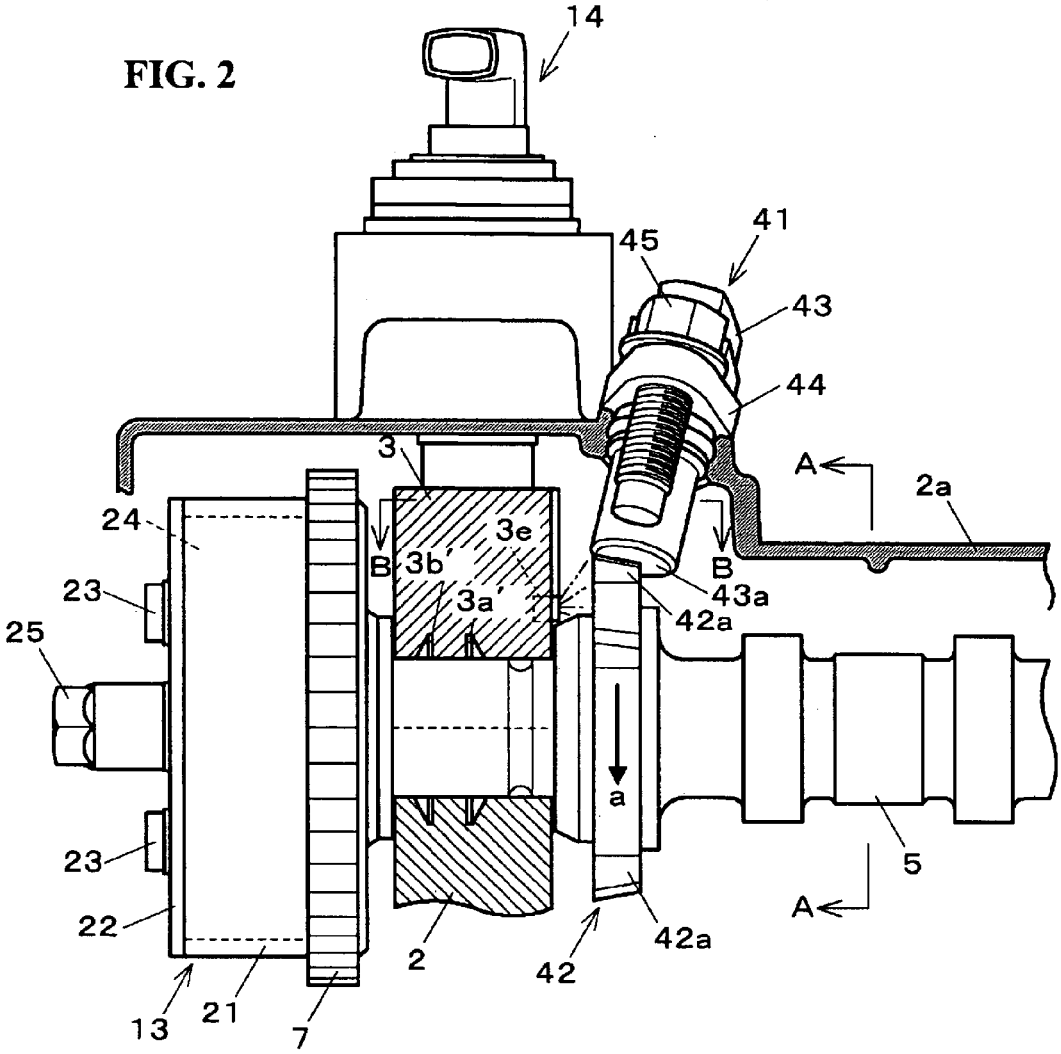
FIG. 2 is a side view for showing part of the valve driving device, where a variable valve timing mechanism is located.

In the present embodiment, the variable valve timing mechanism 13 may use any known structures. Therefore, only schematic structure thereof will be described hereinafter. As shown in FIG. 2, the variable valve timing mechanism 13 comprises a hollow housing 21 having four projections (not shown in any drawing) projecting toward its center and a lid 22 covering an one-side opening of the housing 21. These housing 21 and lid 22 are fixed to the sprocket 7 rigidly through a plurality of bolts 23 . . . 23 (only two of bolts shown in the drawing). The variable valve timing mechanism 13 further comprises a rotor 24 which is located in the housing 21 and includes four projections (not shown in any drawing) projecting radially. The projections of the rotor 24 are capable of contacting the above-described projections of the housing 21. The rotor 24 is fixed to the exhaust camshaft 5 rigidly through a bolt 25. Herein, a space enclosed by the sprocket 7, housing 21, rotor 24 and lid 22 is divided into four of hydraulic (oil) pressure chambers for advance timing and the same number of hydraulic (oil) pressure chambers for delay timing, not shown in any drawings, by corresponding projections of the housing 21 and rotor 24.

Herein, when the operating hydraulic pressure derived from a hydraulic (oil) source (not shown in any drawing) is supplied to the hydraulic pressure chamber for advance timing, the rotor 24 is rotated in the rotational direction of the exhaust camshaft 5 with respect to the housing 21 until the projections of the rotor 24 contacts the corresponding projections of the housing 21. As a result, the rotational phase of the exhaust cam shaft 5 with respect to the crankshaft is changed so as to be advanced, namely, the valve timing of the exhaust valves 12 . . . 12 advances. On the other hand, when the operating hydraulic pressure is supplied to the hydraulic pressure chamber for delay timing, the rotor 24 is rotated in a direction opposite to the rotational direction of the exhaust camshaft 5 with respect to the housing 21 until the projections of the rotor 24 contacts the projections of the housing 21. As a result, the rotational phase of the exhaust cam shaft 5 with respect to the crankshaft is changed so as to be delayed, namely, the valve timing of the exhaust valves 12 . . . 12 delays.

Next, the hydraulic pressure control valve 14, which the valve driving device of the engine 1 is equipped with and controls the supply of the operating hydraulic pressure to the variable valve timing mechanism 13, will be described.

Figure 3:
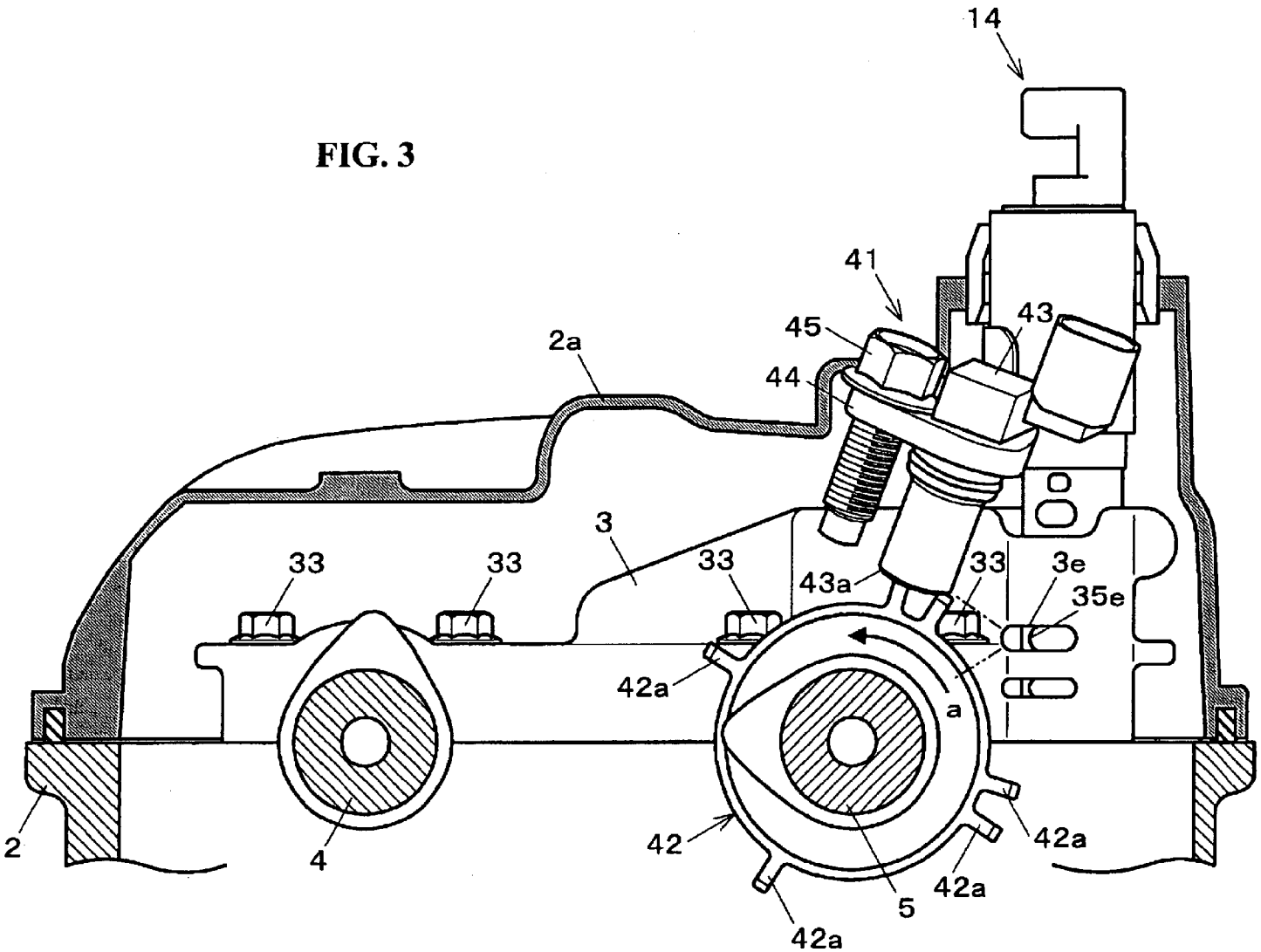
FIG. 3 is a sectional view taken on line A—A of FIG. 2.

As shown in FIGS. 1 to 3, the hydraulic pressure control valve 14 is attached on the cam cap 3 through a bracket 31 by a bolt 32 and disposed such that an axis of the control valve 14 extents substantially in a vertical direction of the engine. The cam cap 3 is fastened by a plurality of bolts 33 . . . 33 on an upper face of an end portion of the cylinder head 2 located at a side of the variable valve timing mechanism 13.

Figure 4:
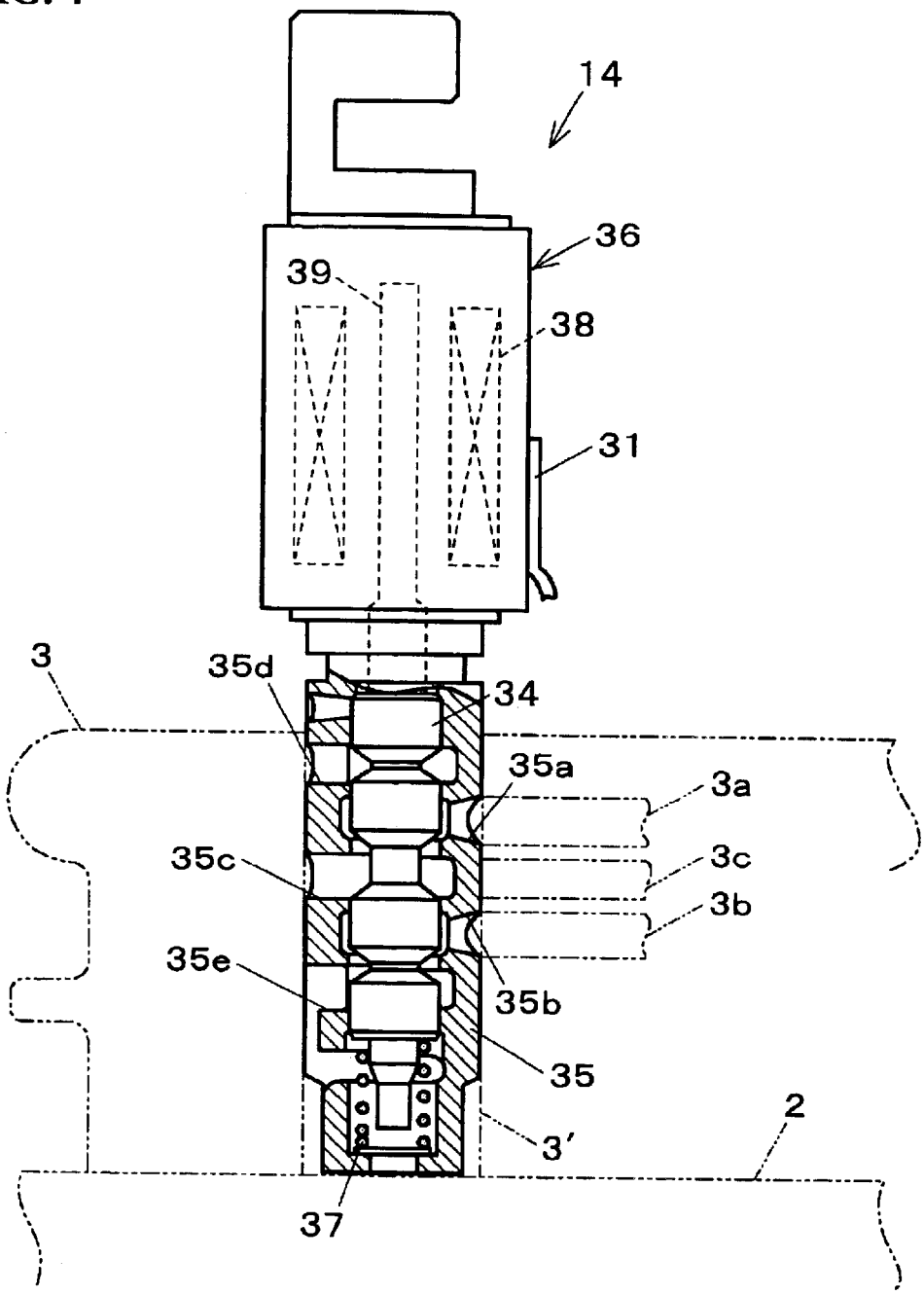
FIG. 4 is a partial sectional view of a hydraulic (oil) pressure control valve.

As shown in FIG. 4, the hydraulic pressure control valve 14 includes a spool 34 with a longer length in its axis direction, a hollow case 35 for containing the spool 34 therein, a solenoid 36 for driving the spool in its axis direction which is located in a base portion (located above in the drawing) of the case 35, and a spring 37 for pushing the spool 34 against the base portion of the case 35 which is disposed in an end portion (located below in the drawing) of the case 35. The solenoid 36 includes a coil 38 and a plunger 39 coupled to a base portion of the spool 34.

Further, the case 35 is provided with two outlet ports 35*a*, 35*b* at one side (at the right side in the drawing) with respect to an axis thereof, which are disposed along a vertical direction of the axis at a certain distance. The case 35 is also provided with one inlet port 35*c* and two drain ports 35*d*, 35*e* at the other side (at the left side in the drawing), which are disposed along the vertical direction of the axis at certain distances in such a manner that the inlet port 35*c* is located between the two drain ports 35*d*, 35*e*. Each of these ports 35*a*–35*e* is flat shaped, having its long axis perpendicular to the axis of the spool 34. The hydraulic pressure control valve 14 is configured such that when the solenoid 36 receives a control signal from an engine control unit or the like (not shown in any drawing), a position of the spool 34 is adjusted accurately by a duty control within the case 35 based on a movement of the plunger 39, thereby controlling a flow rate and/or a flow direction of the operating hydraulic pressure to be applied to the variable valve timing mechanism 13.

On the other hand, the cam cap 3, which functions as a holder for retaining the spool 34 of the hydraulic pressure control valve 14, is provided with an insert hole 3' for receiving the hydraulic pressure control valve 14, which contains the case 35 of the hydraulic pressure control valve 14 therein. Further, the cam cap 3 includes a hydraulic (oil) pressure supply passage 3*c*, a hydraulic (oil) pressure passage for advance timing 3*a*, and a hydraulic (oil) pressure passage for delay timing 3*b*, which are respectively connected to the above-described inlet port 35*c*, outlet ports 35*a*, 35*b*. Further, as shown FIGS. 2 and 3, the cam cap 3 is provided with a drain hole 3*e* which is connected to the lower drain port 35*e*, penetrating the cam cap 3 toward a side where the exhaust camshaft 5 is located. The drain hole 3*e* is flat shaped, corresponding to the above-described drain port 35*e*.

Further, as shown in FIG. 2, the cam cap 3 includes two circumferential grooves 3*a*', 3*b*'. These circumferential grooves 3*a*', 3*b*' constitute respectively part of the above-described hydraulic pressure passage for advance timing 3*a* and hydraulic pressure passage for delay timing 3*b*.

Accordingly, as shown in FIG. 4, for example, when the solenoid 36 is in a non-active state, the spool 34 takes a position where the inlet port 35*c* is connected to the upper outlet port 35*a* and the lower outlet port 35*b* is connected to the lower drain port 35*e*. Herein, the operating hydraulic pressure supplied to the inlet port 35*c* from the hydraulic pressure supply passage 3*c* is supplied from the upper outlet port 35*a* to the hydraulic pressure chamber for advance timing of the variable valve timing mechanism 13 through the hydraulic pressure passage for advance timing 3*a*, the circumferential groove 3*a*'and the like. Meanwhile, the hydraulic pressure in the hydraulic pressure chamber for delay timing of the variable valve timing mechanism 13 is drained from the drain hole 3*e* leading to the lower drain port 35*e* connected to the lower outlet port 35*b* through the circumferential groove 3*b*', the hydraulic pressure passage for delay timing 3*b* and the like.

On the other hand, for example, when the solenoid 36 is in an active state, the spool 34 moves downward against the spring 37 to a position where the inlet port 35*c* is connected to the lower outlet port 35*b* and the upper outlet port 35*a* is connected to the upper drain port 35*d*. Herein, the operating hydraulic pressure supplied to the inlet port 35*c* from the hydraulic pressure supply passage 3*c* is supplied from the lower outlet port 35*b* to the hydraulic pressure chamber for delay timing of the variable valve timing mechanism 13 through the hydraulic pressure passage for delay timing 3*b*, the circumferential groove 3*b*′and the like. Meanwhile, the hydraulic pressure in the hydraulic pressure chamber for advance timing of the variable valve timing mechanism 13 is drained from the upper drain port 35*d* connected to the upper outlet port 35*a* through the circumferential groove 3*a*′, the hydraulic pressure passage for advance timing 3*a* and the like.

Next, a rotational angle detecting mechanism for detecting a rotational angle of the exhaust camshaft 5, with which the valve driving device of the engine 1 is equipped, will be described.

As shown in FIGS. 2 and 3, the rotational angle detecting mechanism 41 comprises a sensor rotor 42, which is attached to the exhaust camshaft 5 relatively close to the cam cap 3, and a solenoid-pickup type of rotational angle sensor 43, an detecting end surface 43*a* of which is disposed close to a rotational area of the sensor rotor 42 rotating in an arrow a direction shown in the drawing. The rotational phase of the exhaust camshaft 5 with respect to the crankshaft of the engine 1 is determined based on the rotational angle of the exhaust cam camshaft 5 detected by the rotational angle sensor 43 and the rotational angle of the crankshaft detected by an another rotational angle sensor provided for the crankshaft (not shown in any drawing).

The sensor rotor 42 is of a substantially disc shape, having six projections 42*a* . . . 42*a* which are formed on its circumference. Herein, there is provided a substantially 90-degree phase difference between positions of two sets of projections 42*a* . . . 42*a*. Namely, there are provided one set of projections 42*a* . . . 42*a* comprising one specified projection 42*a* and two projections 42*a* , 42*a* which are located at the opposite side to the specified projection 42*a* with respect to the exhaust camshaft 5, and the other set of projections 42*a* . . . 42*a* having substantially the same number and shape of projections of the above-described one set, but being located at positions of 90-degree phase advanced or delayed from positions of the above-described one set.

Meanwhile, the rotational angle sensor 43 is attached by a bolt 45 through an attaching member 44 to a portion of an upper wall of a cylinder head cover 2*a* covering the cylinder head 2 which is close to the hydraulic pressure control valve 14, in such a manner that its detecting end surface 43*a* faces toward the sensor rotor 42. The rotational angle sensor 43 is configured so as to generate pulse detecting signals when the detecting end surface 43*a* comes close to the projections 42*a* . . . 42*a* of the sensor rotor 42.

Figure 5:
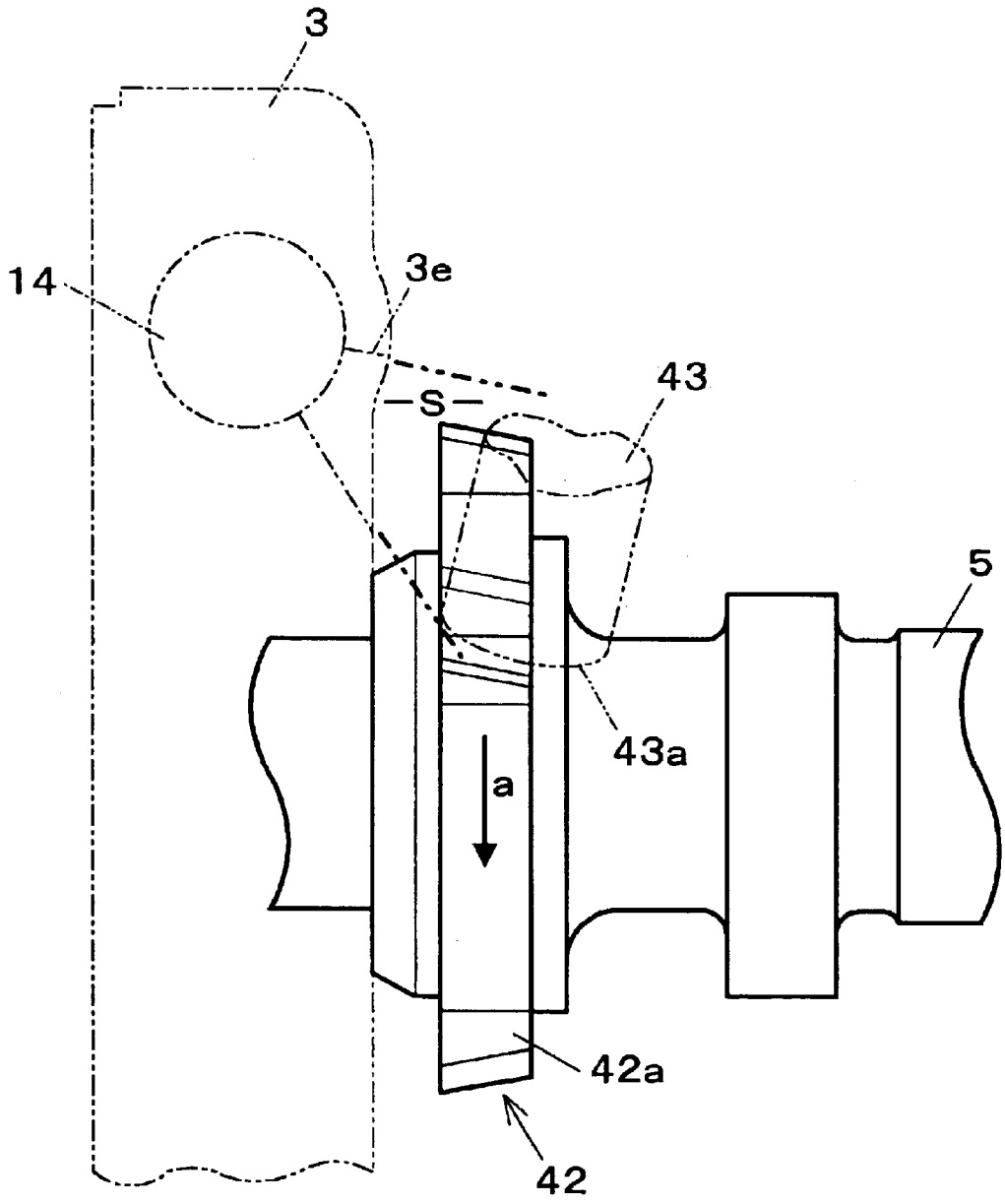
FIG. 5 is a partial enlarged view for illustrating positional relationships of a sensor rotor, a rotational angle sensor and the hydraulic pressure control valve, when viewed from line B—B of FIG. 2.

Further, as shown in FIG. 5, the detecting end surface 43*a* (illustrated as the one facing toward back in the drawing) of the rotational angle sensor 43 disposed close to the sensor rotor 42 is located in a spray area S, shown by two-dotted broken lines, of the return oil discharged through the drain hole 3*e* formed at the cam cap 3, which flows down through the lower drain port 35*e* of the hydraulic pressure control valve 14 from the variable valve timing mechanism 13 (see also FIGS. 2 and 3). Further, the detecting end surface 43*a* is located forward in the rotational direction, shown as the arrow a, of the sensor rotor 42, or the exhaust camshaft 5 (see FIGS. 2 and 3 as well).

Herein, the function of the valve driving device according to the present embodiment will be described.

The rotational angle sensor 43 and the hydraulic pressure control valve 14 are disposed such that the detecting end surface 43*a* of the rotational angle sensor 43, which is located close to the sensor rotor 42 attached to the exhaust camshaft 5, is located in the spray area S of the return oil which comes down from the variable valve timing mechanism 13 through the lower drain port 35*e* of the hydraulic pressure control valve 14 on the cam cap 3 and is discharged through the drain hole 3*e* formed at the cam cap 3. Accordingly, every time the variable valve timing mechanism 13 changes the rotational phase of the exhaust camshaft 5 to an advanced one, the return oil from the variable valve timing mechanism 13 which is discharged through the lower drain port 35*e* connected to the lower outlet port 35*b* of the hydraulic pressure control valve 14 by way of the circumferential groove 3*b*′ and the hydraulic pressure passage for delay timing 3*b* and the like from the hydraulic pressure chamber for delay timing is sprayed from the drain hole 3*e* formed at the cam cap 3 toward the detecting end surface 43*a* of the rotational angle sensor 43. Namely, the return oil can wash properly the detecting end surface 43*a* of the rotational detecting sensor 43 each time. Accordingly, the detecting end surface 43*a* can be prevented from being covered inappropriately with the metal particulates or the like, thereby maintaining properly detecting accuracy of the rotational sensor 43 without any other particular measures.

Further, as shown in FIGS. 2, 3 and 5, the rotational angle sensor 43 is attached to the upper wall of the cylinder head cover 2*a* close to the hydraulic pressure control valve 14. In general, it would be relatively easy to attach some parts to the cylinder head cover 2*a*. Therefore, this could improve flexibility of selection or adjustability of attaching place for the rotational angle sensor 43. Further, the close location of the rotational angle sensor 43 with respect to the hydraulic pressure control valve 14 can assure the above-described washing function of the detecting end surface 43*a* of the rotational angle sensor 43 by the return oil.

Further, the hydraulic pressure control valve 14 is attached on the cam cap 3 such that the axis of the spool 34 extents substantially in the vertical direction of the engine, and the lower drain port 35*e* of the hydraulic pressure control valve 14 and the drain hole 3*e* of the cam cap 3 are flat shaped, having their long axes perpendicular to the axis of the spool 34. Accordingly, as shown in the two-dotted broken lines in FIG. 5, the spray of the return oil discharged through the drain hole 3*e* leading to the drain port 35*e* spreads in a horizontal direction. Thus, it can be relatively easy for the detecting end surface 43*a* of the rotational angle sensor 43 to be located in the return oil's spray area spread in the horizontal direction with its close position to the sensor rotor 42, thereby improving flexibility of its location. Since generally it would be preferred from designing stand point to have more flexibility in the horizontal direction than that in the vertical direction for parts of the engine 1, the above-described disposition of the hydraulic pressure control valve 14 is meaningful.

Further, since the cam cap 3 is used so as to function as the holder for retaining the hydraulic pressure control valve 14, or spool 34, this embodiment has the advantage of a simple structure with small-number parts and compactness.

Further, the detecting end surface 43*a* of the rotational angle sensor 43 is located forward in the rotational direction, shown as the arrow a of FIGS. 2, 3 and 5, of the sensor rotor 42, or the exhaust camshaft 5. Accordingly, the return oil discharged through the drain hole 3*e* of the cam cap 3 by way of the lower drain port 35*e* of the hydraulic pressure control valve 14 can be positively carried toward the rotational angle sensor 43 by the rotation of the sensor rotor 42 or the projections 42*a* . . . 42*a*, which are attached to the exhaust camshaft 5. As a result, the amount of oil carried to the detecting end surface 43*a* increases. Thus, it can promote washing of the detecting end surface 43*a* of the rotational angle sensor 43 by the return oil.

Herein, although it is configured such that the cam cap 3 functions as the holder for retaining the hydraulic pressure control valve 14, or spool 34 in the present embodiment, an additional member different from the cam cap 3 may be used as the holder.

Further, although the hydraulic pressure control valve 14 is disposed such that the axis of the spool 34 extents substantially in the vertical direction of the engine in the present embodiment, the disposition of the hydraulic pressure control valve 14 should not be limited to this. According to design needs or the like, some modified disposition of the hydraulic pressure control valve 14 may be used within the scope of the present invention. That is, it may be disposed, for example, such that the axis of the spool 34 extends in a lateral direction or a inclined direction of the engine.

Further, although there are provided the variable valve timing mechanism 13, the hydraulic pressure control valve 14, the rotational angle detecting mechanism 41 and the like at the exhaust camshaft 5 in the present embodiment, there may be provided these devices at the intake camshaft 4. In this case, of course, the same functions and effects described above can be obtained.

Any other additional modifications may be applied within the scope of the present invention.

What is claimed is:

1. A valve driving device for an engine, comprising:

a variable valve timing mechanism disposed at an end portion of a camshaft driving an intake valve and/or an exhaust valve synchronously with a crankshaft of the engine, the variable valve timing mechanism being a hydraulic-pressure operating type of variable valve timing mechanism that is capable of changing a rotational phase of the camshaft with respect to the crankshaft;

a hydraulic pressure control valve operative to control a supply of an operating hydraulic pressure to said variable valve timing mechanism;

a rotational angle sensor operative to detect a rotational angle of the camshaft, the rotational angle sensor being a solenoid-pickup type of sensor and including a detecting end surface that is disposed close to a rotational area of a sensor rotor attached to the camshaft, wherein said hydraulic pressure control valve includes a drain hole, return oil from said variable valve timing mechanism is discharged through the drain hole of said hydraulic pressure control valve, and said rotational angle sensor and said hydraulic pressure control valve are disposed such that the detecting end surface of said rotational angle sensor is located in a spray area of the return oil discharged through the drain hole.

2. The valve driving device for an engine of claim 1, wherein said hydraulic pressure control valve further includes a spool, a holder for retaining the spool and a solenoid for driving the spool, and said drain hole is formed at the holder.

3. The valve driving device for an engine of claim 1, wherein said rotational angle sensor is attached to a portion of a cylinder head cover that is close to said hydraulic pressure control valve.

4. The valve driving device for an engine of claim 2, wherein said hydraulic pressure control valve is disposed such that an axis of the spool thereof extents substantially in a vertical direction of the engine.

5. The valve driving device for an engine of claim 1, wherein said rotational angle sensor is disposed so as to locate close to and at the front of the drain hole of said hydraulic pressure control valve with respect to a rotational direction of the camshaft.

6. A valve driving device for an engine, comprising:

a variable valve timing mechanism disposed at an end portion of a camshaft driving an intake valve and/or an exhaust valve synchronously with a crankshaft of the engine, the variable valve timing mechanism being a hydraulic-pressure operating type of variable valve timing mechanism that is capable of changing a rotational phase of the camshaft with respect to the crankshaft;

a hydraulic pressure control valve operative to control a supply of an operating hydraulic pressure to said variable valve timing mechanism, the hydraulic pressure control valve including a spool, a holder for retaining the spool and a solenoid for driving the spool;

a rotational angle sensor operative to detect a rotational angle of the camshaft, the rotational angle sensor being a solenoid-pickup type of sensor and including a detecting end surface that is disposed close to a rotational area of a sensor rotor attached to the camshaft, wherein said hydraulic pressure control valve further includes a drain hole that is formed at the holder, return oil from said variable valve timing mechanism is discharged through the drain hole of said hydraulic pressure control valve, and said rotational angle sensor and said hydraulic pressure control valve are disposed close to each other such that a spray of the return oil discharged through the drain hole is directed toward the detecting end surface of said rotational angle sensor.

7. The valve driving device for an engine of claim 6, wherein said rotational angle sensor is attached to a portion of a cylinder head cover that is close to said hydraulic pressure control valve.

8. The valve driving device for an engine of claim 6, wherein said hydraulic pressure control valve is disposed such that an axis of the spool thereof extents substantially in a vertical direction of the engine.

9. The valve driving device for an engine of claim 6, wherein said rotational angle sensor is disposed so as to locate close to and at the front of the drain hole of said hydraulic pressure control valve with respect to a rotational direction of the camshaft.

10. The valve driving device for an engine of claim 6, wherein the holder of said hydraulic pressure control valve is formed of a cam cap that supports the camshaft rotatably together with a cylinder head of the engine.

* * * * *